United States Patent [19]

Knight

[11] 4,404,688

[45] Sep. 20, 1983

[54] COMBINATION SCARF

[76] Inventor: Phyllis Knight, 505 N. Lake Shore Dr., Chicago, Ill. 60611

[21] Appl. No.: 345,216

[22] Filed: Feb. 3, 1982

[51] Int. Cl.[3] ..... A42B 5/00; A42D 23/00; A42B 1/04

[52] U.S. Cl. ..... 2/207; 2/91; 2/203

[58] Field of Search ..... 2/207, 208, 203, 91

[56] References Cited

U.S. PATENT DOCUMENTS

| | | | |
|---|---|---|---|
| 1,181,359 | 5/1916 | Van Raalte | 2/207 |
| 1,211,807 | 1/1917 | Aidenland | 2/203 |
| 2,167,228 | 7/1939 | Wood | 2/198 |
| 3,060,449 | 10/1962 | Lehnhard | 2/203 |

FOREIGN PATENT DOCUMENTS

| | | | |
|---|---|---|---|
| 1055414 | 10/1953 | France | 2/207 |

*Primary Examiner*—Doris L. Troutman

*Attorney, Agent, or Firm*—John H. Shurtleff

[57] ABSTRACT

A combination scarf as fashionable wearing apparel comprising an elongated, generally rectangular, one-piece fabric member which has a short front panel section at one end and a comparatively long trailing panel section at the other end, this trailing section being divided lengthwise into two separate elongated panels, with a collar-forming yoke section joining the other two sections and containing a teardrop opening arranged therein to provide a circular leading edge to fit around the front of the neck and a pair of tapering trailing edges to fit the scarf to the sides and back of the neck.

6 Claims, 5 Drawing Figures

COMBINATION SCARF

BACKGROUND OF THE INVENTION

The invention relates to a combination scarf which will fit around the neck as wearing apparel for the human body and which can be worn in a number of different ways to provide a fashionable appearance to the wearer who may be a man, woman or child. The term "combination scarf" is used to indicate the utility of the scarf as a multi-purpose article of clothing in addition to its differrent modes or styles of being worn.

A scarf is generally any broad band of cloth or fabric material adapted to be worn about the shoulders, around the neck or over the head. Depending on the overall size of the scarf, it may be used as a shawl or cloak-like garment over the shoulders, as a muffler around the neck or as a head covering garment. A garment which serves a similar purpose is a turtleneck dickey which is pulled down over the head to provide a double ring of fabric around the neck while providing a short front and/or back panel, usually inserted inside of a shirt, sweater or the like. These common garments can be worn in only a limited way and offer only limited styles or fashions.

SUMMARY OF THE INVENTION

It is an object of the present invention to provide a combination scarf having multimodal utility and fashionability, through modification of a fabric material having a generally rectangular shape, using simple fabricating methods and avoiding excessive waste of unused material. Moreover, it is an object of the present invention to provide a scarf with trailing ends which can serve not only as a scarf but as an ornamental bow, cravat or other stylish mode of dress. Further, it is an object of the invention to combine the trailing ends of the scarf with an additional panel member which can serve as a dickey or as a part of the desired fashionable appearance when viewed on the wearer.

These and other objects have been accomplished, in accordance with the present invention, by providing a combination scarf as highly fashionable wearing apparel for the human body in the form of an article comprising an elongated, generally rectangular, one-piece fabric or cloth member characterized by a short front panel section, a much longer trailing panel section composed of two separate elongated segments and a collar-forming yoke section joining the the other two sections and containing a teardrop center opening with a circular leading edge to fit around the front of the neck and a pair of tapering trailing edges which run into or join with the inner facing edges of the trailing panel section.

These and other specific objects and advantages of the invention will become more apparent upon reviewing the following detailed specification together with the accompanying drawings wherein a few embodiments of the combination scarf are given by way of illustration without being considered exclusive.

THE DRAWINGS

DESCRIPTION OF THE PREFERRED EMBODIMENTS

Figure 1:
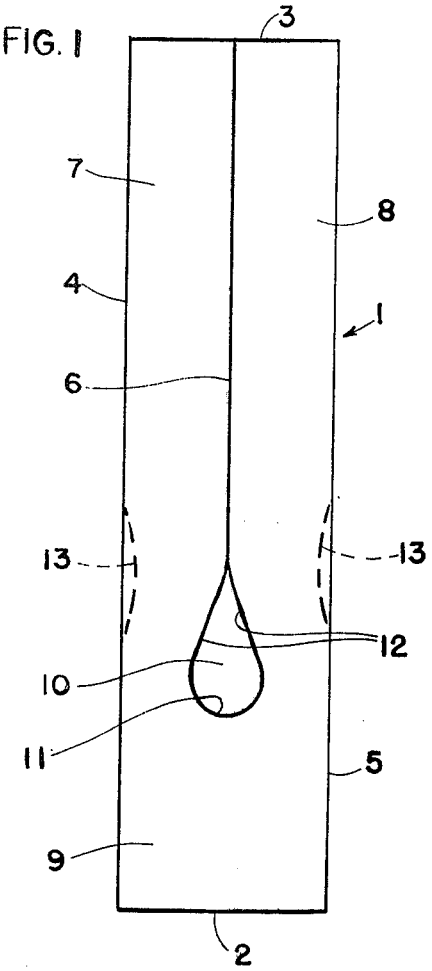
FIG. 1 is a top plan view of the one-piece fabric material as it is initially cut from a double layer of cloth and before it is sewn together to form seams along the cut edges, the broken lines indicating an alternative construction.

In the preferred embodiments of the invention shown in the drawings, the combination scarf is constructed from a two-layer rectangular piece of cloth 1, with or without a liner, measuring about 11 inches in width and about 45 inches in length before it is cut (FIG. 1) and about 10 inches in width and about 43 or 44 inches in length after cutting and sewing seams of approximately ½-inch around all the cut edges. This rectangular cloth 1 can be cut from large bolts or lengths of any suitable cloth such as wool, cotton, polyester, silk, rayon and other textile fabrics, including blends or composite materials. For example, out of a piece of cloth measuring 2½ yards by 45 inches, one can obtain four adult size scarfs according to the invention with practically no wasted material. From a piece measuring 2½ yards by 60 inches, it is possible to get the same four adult size scarfs plus two child size scarfs, the latter preferably measuring about 7 inches in width and 30 inches in length in final form (FIG. 2).

Figure 2:
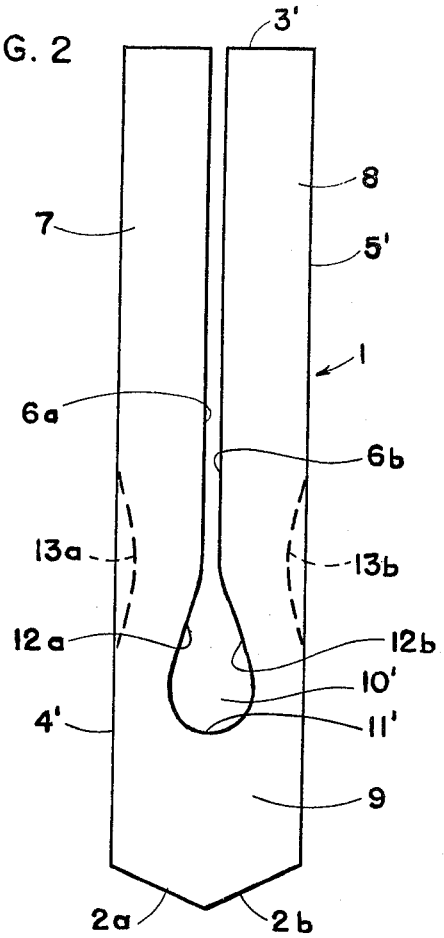
FIG. 2 is a top plan view similar to FIG. 1 but illustrating the appearance of the finished article after it has been seamed, again with broken lines to illustrate an alternative shape.

Referring first to FIGS. 1 and 2, each two-layer cloth 1 from which the scarf is made has a front edge 2, a back edge 3 and two generally parallel side or lateral edges 4 and 5. In general, all four edges of the two-layer cloth will be cut edges as shown in FIG. 1 although it would be possible to have one or even two folded lateral edges to eliminate one or two seaming steps. From the back edge 3, a longitudinal cut 6 is made to separate the trailing panel section of the cloth into two equal panel segments 7 and 8 which extend longitudinally over more than half the length of the entire cloth 1. A square or small rectangular front panel 9 is retained adjacent the front edge 2 of the cloth 1. Between this front panel 9 and the two panel segments 7 and 8 of the trailing panel section of the cloth, a teardrop opening 10 is cut out of the cloth 1 in an intermediate panel section which will be identified herein as the "yoke section" which helps to form a smoothly fitting collar on the wearer of the scarf as well as connecting or joining the panel segments 7 and 8 with the front panel 9.

Once the two-layer cloth has been cut in the pattern shown in FIG. 1, together with any liner initially arranged on an outer side, all the edges except the back edge 3 of both panel segments 7 and 8 can be machine stitched, e.g. using a seam of about ¼-inch to ½-inch depending upon the weight or thickness of the cloth material. The article is then in the form of a tube which begins at the back edge 3 of one panel segment 7 and ends at the back edge of the other panel segment 8. This tube is turned inside out so that all of the machine stitched seams become hidden. The two back edges 3 of the panel segments 7 and 8 can then be carefully hand-tailored to provide blind-stitched edges or else these edges can be adhered together using a two-sided adhesive tape or the like, again with the seam edges being turned inside of the tube.

The scarf after it has been stitched and fully seamed and ready to wear will have the general appearance shown in FIG. 2, i.e. with the back blind-stitched edge being designated as 3′ and with the two other limiting edges being designated as 4′ and 5′. The front edge 2 as shown in FIG. 1 has been modified in FIG. 2 so as to be cut and seamed on an angle on either side of the longitudinal centerline of the scarf, thereby providing the two oblique or slanted edges 2*a* and 2*b* as a more ornamental or stylish shape when this portion of the scarf is viewed below the neck of the wearer. Such minor variations in the size, style or shape of the front edge 2 of the scarf can be done without departing from the spirit or scope of the invention. The same treatment can be applied to the back edges 3 of the panel segments 7 and 8 while still retaining a scarf of generally rectangular configuration.

Due to the provision of seams, the two inner facing edges 6*a* and 6*b* in the trailing section of the scarf will be spaced apart by a short interval, e.g. about ½- to 1-inch, if the scarf is laid out in a flat, smooth position as seen in FIG. 2. The resulting slot leads into the teardrop opening 10′ which is slightly enlarged from FIG. 1, again due to being seamed. The inwardly facing edges of the opening 10 or 10′ need to be shaped in a particular manner in order for the yoke section of the scarf to form a well-shaped and form-fitting collar as the two trailing panel segments 7 and 8 are wound in opposite directions around the neck of the wearer. Thus it has been found to be highly desirable for the leading or forward edge 11 and 11′ of the teardrop opening to be made circular in shape, e.g. so as to present the front page of this opening adjacent the front panel 9 in the form of a semicircle or something reasonably close to a semicircle. At the same time, the opening should have a trailing edge 12*a* and 12*b* on opposing sides of the teardrop opening 10′, these trailing edges tapering backwardly from either side of the circular leading edge 11′ to join the respective inner facing edges 6*a* and 6*b* of the two longitudinal panel segments 7 and 8. Some variation in the teardrop shape of the opening 10′ is possible, e.g. so that the trailing edges 12*a* and 12*b* can meet the facing edges 6*a* and 6*b*, respectively, at a very wide angle as viewed on the material side or else these edges can be joined with a gradual curve. In providing stitched seams for these circular or curved edges, it is helpful to cut notches in the excess seam or otherwise remove some of the peripheral seam material to avoid bunching or wrinkling of the fabric along these edges.

With this teardrop opening in the yoke section of the scarf, one finds that the final shape of the collar formed by the winding of the trailing segments 7 and 8 around the neck conform to the circular or slightly oval cross-section of the neck. Moreover, this effect is achieved even when the scarf is not made to the exact dimensions of this neck cross-section, so that one can fit practically all adults with three sizes, i.e using the conventional designation of "small", "medium" and "large" sizes. Similarly, a child's scarf needs only one size opening 10′ to fit most children attracted to this kind of stylish scarf.

As shown in FIG. 2, the narrowest part of the scarf falls in that area directly adjacent the largest diameter of the opening 10′, i.e. corresponding to the base diameter of the semicircular front portion of the opening. As indicated by the broken lines 13 and 13*a*, 13*b* of both FIGS. 1 and 2, the outer limiting edges of the cloth 1 along the panel segments 7 and 8 and extending into the yoke section can be partly cut away and seamed so as to reduce the width of each panel and its extension as it leads into the yoke section. This permits the panel width to be narrowed in a zone extending a short distance along the trailing edges 12 and 12*a*, 12*b* in order to prevent excessive material from being placed around the neck, i.e. at the place where each part of the yoke section turns off the shoulder to wrap around the back of the neck in a more vertical position relative to the wearer in a standing or upright position. This preferred construction requires only a little additional care in cutting and stitching the scarf and still does not depart from the use of a generally rectangular one-piece fabric material.

Figure 3:
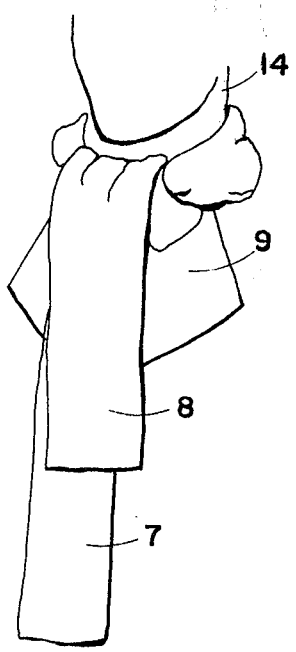
FIGS. 3, 4 and 5 are perspective views to illustrate three different ways in which the combination scarf can be worn, with or without accessories.
Figure 4:
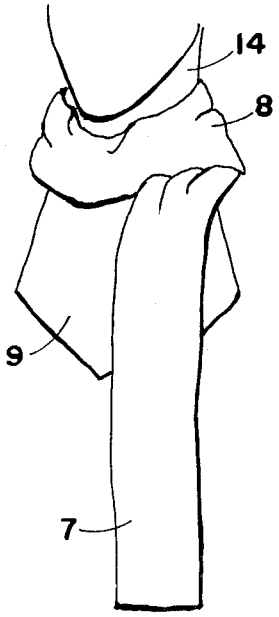
Figure 5:
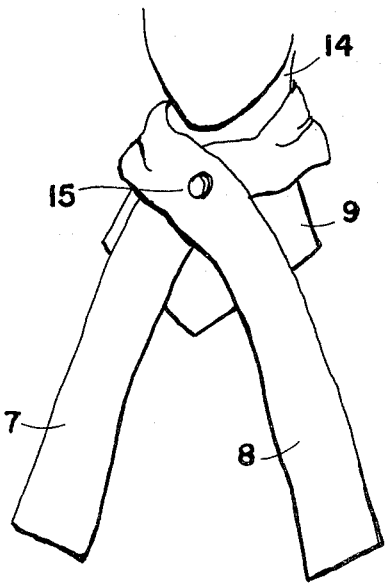

FIGS. 3, 4 and 5 suggest some of the ways in which the scarf can be worn around the neck 14, for example by wrapping the ends 7 and 8 around the neck and then tying a single knot as in FIG. 3 or simply passing one end 8 over the shoulder as in FIG. 4. It is also possible to hold the two ends in place by means of a pin or broach 15 as indicated in FIG. 5. A simple bow can also be tied with the two ends 7 and 8 or one may provide a more complex knot as with a necktie, depending on the weight and size of the fabric material. The front panel or dickey 9 can be left on the outside to be seen as part of the scarf or may be inserted inside of a shirt or blouse. One may also provide a relatively large front panel which can serve in place of a shirt or blouse, e.g. when inserted inside of a sweater, blazer, jacket or similar outerwear.

These and other variations in the use of the combination scarf of the invention will be readily suggested to those who have some knowledge of fashions. The scarf is also versatile in that it can be made in contrasting or different colors on each side or with different patterns to provide still further pleasing effects. One scarf thus provides an article of clothig which can be used in many different ways as a valuable accessory or supplement to a normal wardrobe.

The invention is hereby claimed as follows:

1. A combination scarf as fashionable wearing apparel for the human body comprising an elongated, generally rectangular, one-piece fabric member having:
   - a proportionately short front panel section at one end of the fabric member which is adapted to cover at least a portion of the breast of said body;
   - a proportionately long trailing panel section extending to the other end of the fabric member and being separated into two essentially rectangular, longitudinal panel segments with parallel inner facing edges and outer limiting edges which define each panel segment; and
   - a collar-forming yoke section joining said front panel section with said trailing panel section and containing a teardrop center opening with a substantially circular leading edge adjacent the front panel section and a tapering trailing edge extending from each side of the circular leading edge to join with one of the parallel inner facing edges of said longitudinal panel segments.

2. A combination scarf as claimed in claim 1 wherein the one-piece fabric member consists essentially of a two layer cloth, with or without a liner, and with most of its edges seamed and turned to the inside.

3. A combination scarf as claimed in claim 1 wherein said front panel is sufficiently large to be inserted as a dickey into an outerwear garment.

4. A combination scarf as claimed in claim 1 wherein the parallel outer longitudinal limiting edges of said fabric member extend along said panel segments into the yoke section and are partly cut away in said yoke section to gradually reduce the width of each panel as it leads into said yoke section.

5. A combination scarf as claimed in claim 1 wherein the tear drop opening has an approximately semicircular front portion defining its circular leading edge.

6. A combination scarf as claimed in claim 5 wherein the parallel outer longitudinal limiting edges of said fabric member extend along said panel segments into the yoke section and are partly cut away in said yoke section along an arcuate line so that each panel segment necks down into said yoke section.

* * * * *